US005307051A

United States Patent [19]

Sedlmayr

[11] Patent Number: 5,307,051

[45] Date of Patent: Apr. 26, 1994

[54] NIGHT LIGHT APPARATUS AND METHOD FOR ALTERING THE ENVIRONMENT OF A ROOM

[76] Inventor: Steven R. Sedlmayr, 1948 E. Ellis Cir., Mesa, Ariz. 85203

[21] Appl. No.: 764,777

[22] Filed: Sep. 24, 1991

[51] Int. Cl.[5] ..... G08B 21/00

[52] U.S. Cl. ..... 340/573; 40/473; 340/540; 340/575; 340/692; 446/175; 446/227

[58] Field of Search ..... 340/573, 575, 540, 692; 181/0.5; 307/117; 362/276, 802, 458, 253; 446/175, 227; 40/473, 457

[56] References Cited

U.S. PATENT DOCUMENTS

| | | | |
|---|---|---|---|
| 3,038,060 | 6/1962 | Diehl | 240/2 |
| 3,361,902 | 1/1968 | Cardenas et al. | 362/86 |
| 3,459,961 | 9/1969 | Ravas | 307/116 |
| 4,038,561 | 7/1977 | Lorenz | 307/141 |
| 4,052,622 | 10/1977 | Lorenz | 307/112 |
| 4,107,464 | 8/1978 | Lynch et al. | 340/692 |
| 4,285,028 | 8/1981 | Sundin et al. | 362/276 |
| 4,298,915 | 11/1981 | Goldfarb et al. | 362/124 |
| 4,318,159 | 3/1982 | Kaisner | 362/124 |
| 4,346,374 | 8/1982 | Groff | 340/540 |
| 4,433,362 | 2/1984 | Ban | 362/86 |
| 4,631,675 | 12/1986 | Jacobsen et al. | 364/400 |
| 4,640,034 | 2/1987 | Zisholtz | 446/227 |
| 4,670,820 | 6/1987 | Eddins et al. | 362/86 |
| 4,690,242 | 9/1987 | Mark | 181/0.5 |
| 4,751,625 | 6/1988 | Lin | 362/276 |
| 4,816,809 | 3/1989 | Kim | 340/692 |
| 4,984,380 | 1/1991 | Anderson | 446/175 |
| 5,014,039 | 5/1991 | Zelenka | 340/565 |
| 5,019,950 | 5/1991 | Johnson | 362/130 |

*Primary Examiner*—Glen R. Swann, III
*Attorney, Agent, or Firm*—Stephen A. Gratton

[57] ABSTRACT

A night light apparatus and method alters the environment of a room, particularly a darkened room, in response to an audio input such as a child's voice. The apparatus and method is adapted to provide a sense of security to a child in a room in order to improve the child's sleeping habits and reduce or eliminate the child's fear of the dark or the child's fear of being left alone. A predetermined audio level in the darkened room is sensed. If the audio level exceeds a background noise level, a signal is generated and an audio output and a light output are activated. The audio output may include a bedtime story or a soothing song. The light output may include an image such as a cartoon character that is lit. A fire and smoke detector may also be included to activate audio instructions to a child in the event of a fire. The apparatus may be suitably programmed to transmit a signal to a remote location and activate an object warning device and/or a motion generating device.

101 Claims, 6 Drawing Sheets

NIGHT LIGHT APPARATUS AND METHOD FOR ALTERING THE ENVIRONMENT OF A ROOM

FIELD OF THE INVENTION

The present invention relates to lighting and audio apparatus and methods which are useful for altering the environment of a room. The present invention is particularly, but not exclusively, adapted to apparatus and methods for altering the environment of a darkened room in response to an audio input such as a child's voice for providing a sense of security to a child.

BACKGROUND OF THE INVENTION

Every parent has experienced the frustration of a young child who cannot sleep. This problem is especially acute when the child is moved from a crib to his or her own bed. To alter the environment of a darkened room and to provide a sense of security to the child, it is known to provide a night light apparatus which emits a soft or diffuse light in the child's room. Such night light apparatus are typically simple low intensity lighting fixtures adapted to be plugged into a standard wall socket. The lighting fixture may be in the shape of a figure such as a cartoon character that may be reassuring to a child.

Alternately, the night light apparatus can be made in the form of a holdable doll figure such as shown in U.S. Pat. No. 4,298,915 to Goldfarb et al. In the Goldfarb et al patent, the doll figure has a movable portion, such as an arm, in which a light is supported. When the arm is lifted, the light is activated. Another prior art night light apparatus, U.S. Pat. No. 4,670,820 to Eddins et al, discloses an animated night light and music box combination. Yet, another night light apparatus is manufactured by Mattel, Inc., of Hawthorne, Calif. under the trademark "Dreamtime Carousel TM". This night light continuously projects rotating pictures on the ceiling area adjacent to a child's bed and plays a tune. Another night light apparatus manufactured by Kidstar, a division of Monogram Models, Inc. (made in Korea), provides a cassette player that is manually switch activated and a light that is also manually switch activated. This apparatus is formed from plastic in the shape of "Mother Goose."

While such night light apparatus have some benefits, they are not completely effective in altering the environment of a darkened room enough to provide a sense of security to the child. Since they are generally either static or manually operable devices, they typically do not function in response to input from the child to appreciably alter the environment of the room. A small child or baby may only be capable of a voice input such as by crying. Consequently, the effect of these devices may be diminished over the course of time or over the course of an evening. Accordingly, there is a need in the art for a night light apparatus and method for altering the environment of a room to provide a sense of security to a child that is responsive to voice input from the child. It is thus an object of the present invention to provide a night light apparatus and method of altering the environment of a room responsive to voice input from the child.

It is further object of the invention to provide a night light apparatus that functions to alter the environment of a darkened room with a light output such as a lit cartoon character and an audio output such as bedtime story. It is yet another object of the invention to provide a night light apparatus that may include a means for detecting fire or smoke and for instructing a child in a course of action.

BRIEF SUMMARY OF THE INVENTION

In accordance with the present invention, a night light apparatus and method adapted to alter the environment of a darkened room in response to a child's voice input is provided. The apparatus and method of the invention simply stated, senses a predetermined audio level in the darkened room for a predetermined period of time (T1). If the audio level is then exceeded by the sounds of a child (i.e., crying) a signal is generated and an audio output and a light output are generated for another predetermined period of time (T2). The audio output and light output may be sounds and sights that are reassuring to a child such as a bedtime story and a lighted cartoon figure. After time period T2, the audio level in the room is then sensed again and the process is repeated throughout the night. Whenever the child wakes up and makes a sound, a signal is generated triggering a signal that generates the reassuring audio and light outputs. Additionally, the apparatus and method may be adapted to detect fire and smoke and provide audio information for instructing the child on a course of action.

The night light apparatus of the invention is adapted to carry out the method of the invention. The night light apparatus simply stated includes a housing, with an audio output means such as an audio device and a light output means such as a lighted cartoon figure mounted thereon. Control means preferably electronic, are provided for continuously detecting a predetermined audio level in the room to generate a signal. This signal in turn generates the audio output and light output for a predetermined period of time (T2).

In a preferred embodiment the light output means includes a surface portion formed on the housing and lit by one or more a fluorescent lights. The surface portion is preferably formed of a translucent material and may include a recognizable character such as a cartoon character. Alternately the housing may be formed in the shape of a familiar toy object such as a truck, boat, airplane, or the like. An audio output means may include one audio device supported in the housing for generating a prerecorded bedtime story.

In a preferred embodiment, the electronic control means comprises a trigger for activating the audio devices to generate the audio output and for activating the lamps to light the surface portion of the housing. A retriggerable timer controls the time period (T2) during which the trigger is activated. The timer is controlled by a circuit that includes a start switch, audio and light detection means, and first and second gates. The audio detection means detects sound levels above a noise threshold, and the light detection means detects light levels below a light threshold for a predetermined time period designated as (T1). The first gate is coupled to receive the outputs of the audio detection and the light detection means for generating an output when a detected sound level is above a noise threshold and a light level is below the light threshold (i.e., the room is darkened). The second gate has first and second inputs and an output connected to the timer, the first input of the second gate is connected to receive the output of the first gate and the second input is connected to receive the output of the start switch. In operation, depression of the start switch activates the timer and the figure is lit while a story is told. When the timer times-out, the audio device and the lamp are turned off. Preferably, the level of the audio and the intensity of the light may be reduced gradually or at least during the later part of the predetermined period of time (T2). Thereafter, the audio detector responds to noises above a predetermined threshold for retriggering the timer for turning on the lamp and player device again.

The night light apparatus may also include a second audio device for generating an audio output simulating a mother's heartbeat. Additionally, the night light apparatus may include a fire/smoke detector and means responsive to the detection of fire or smoke for generating an audio output to the child. Such audio output may include instructions for the child to take certain protective actions due to the emergency. The night light apparatus may be programmed to activate a means for warming an object such as a bottle of liquid and/or a means for generating motion such as a crib or a childs' bed. The night light apparatus may also be programmed to sense the number of times a predetermined audio level has been sensed within a predetermined period of time (T4) and to generate a signal in response to a predetermined number of times said predetermined audio level has been sensed, followed by the generation of a signal to activate a transmitter for transmitting a signal to a remote location, and to receive at a remote location the signal generated by said transmitter. Finally, the night light apparatus may also include means for providing an image in the room and means for providing fiber optic means to convey the generated light to the image. A portion of the image may be formed, in part, by fiber optic means.

Other objects, advantages, and capabilities of the present invention will become more apparent as the description proceeds.

DETAILED DESCRIPTION

Figure 1:
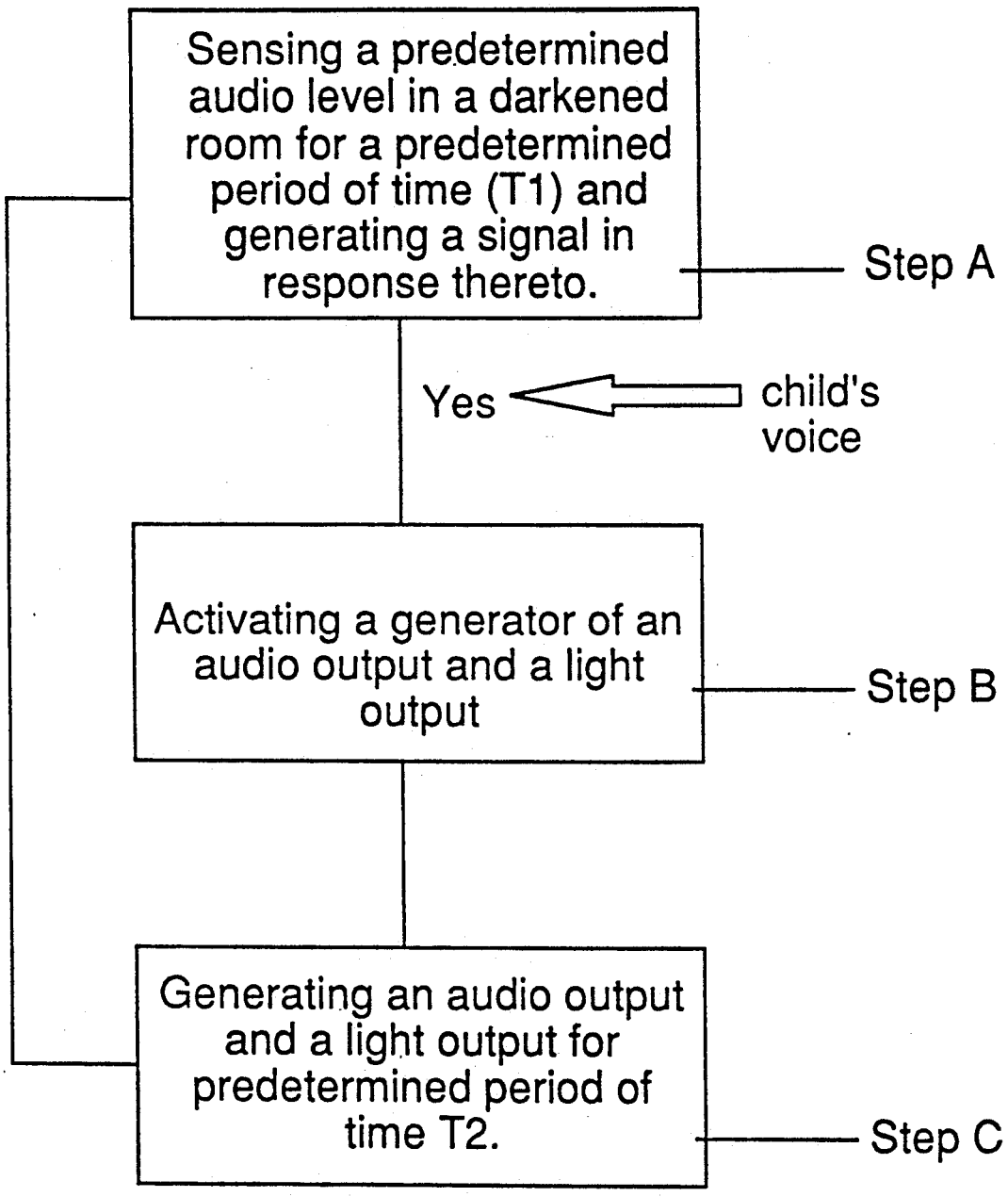
FIG. 1 is a schematic diagram showing the steps involved with the method of the invention.

Referring now to FIG. 1, a method of altering the environment of a room in response to a child's voice input operable for providing a sense of security to a child in accordance with the invention is shown. The method of the invention broadly stated includes the steps of:

sensing a predetermined audio level in a darkened room for a predetermined period of time (T1) and generating a signal in response thereto, step A;

activating a generator of an audio output and a light output responsive to the signal, step B;

following activation of the generator, generating an audio output and a light output in the darkened room for a predetermined period of time (T2), step C;

following generation of the audio output and light output for the predetermined period of time (T2) the predetermined audio level is sensed again and the process is repeated.

Figure 2:
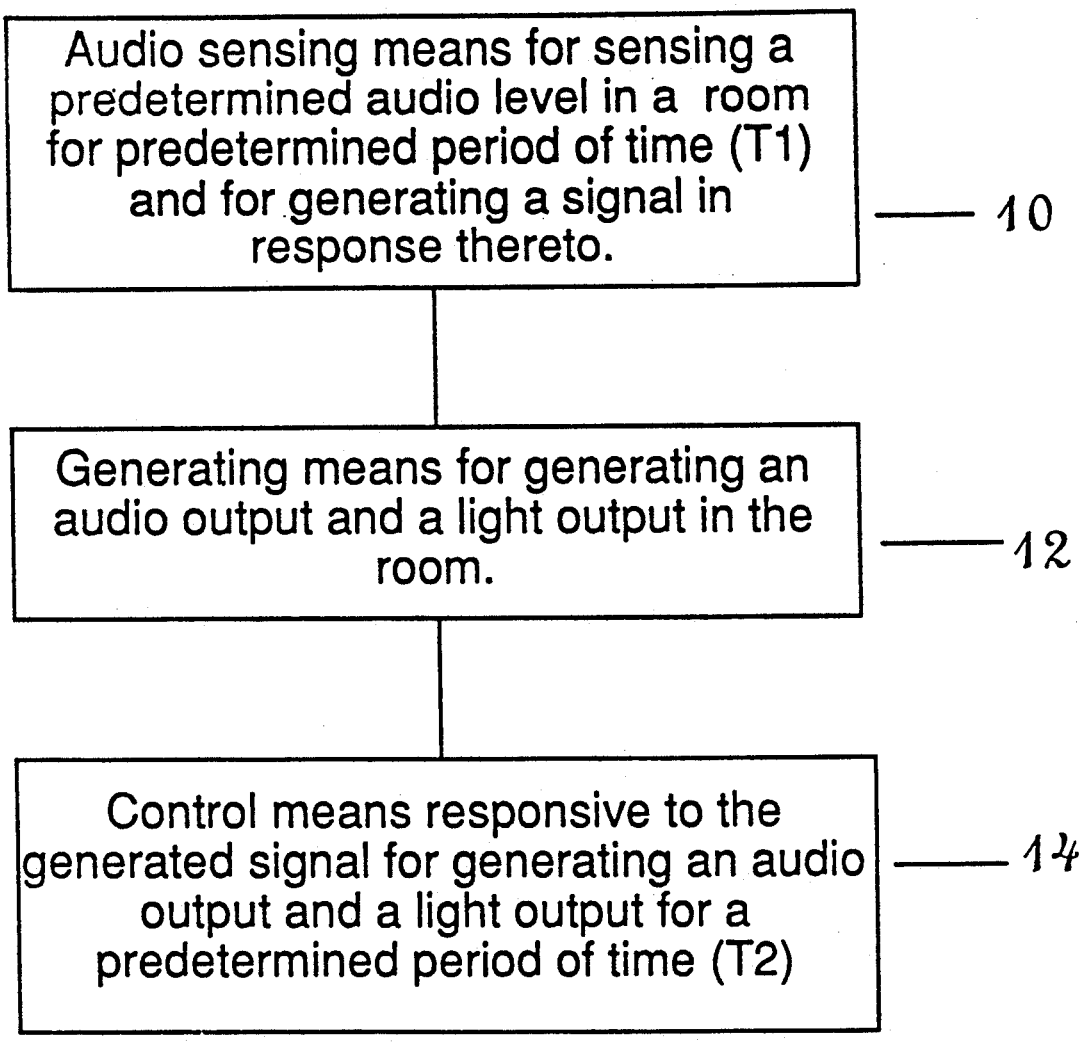
FIG. 2 is a block diagram of the basic elements of the night light apparatus of the invention.

An apparatus constructed in accordance with the invention is shown schematically in FIG. 2 and broadly stated includes:

audio sensing means for sensing a predetermined audio level in a darkened room for a predetermined period of time (T1) and for generating a signal in response thereto, 10;

generating means for generating an audio output and a light output in the darkened room, 12; and control means responsive to the generated signal for activating the generating means for generating an audio output and a light output for a predetermined period of time (T2), 14.

Figure 3:
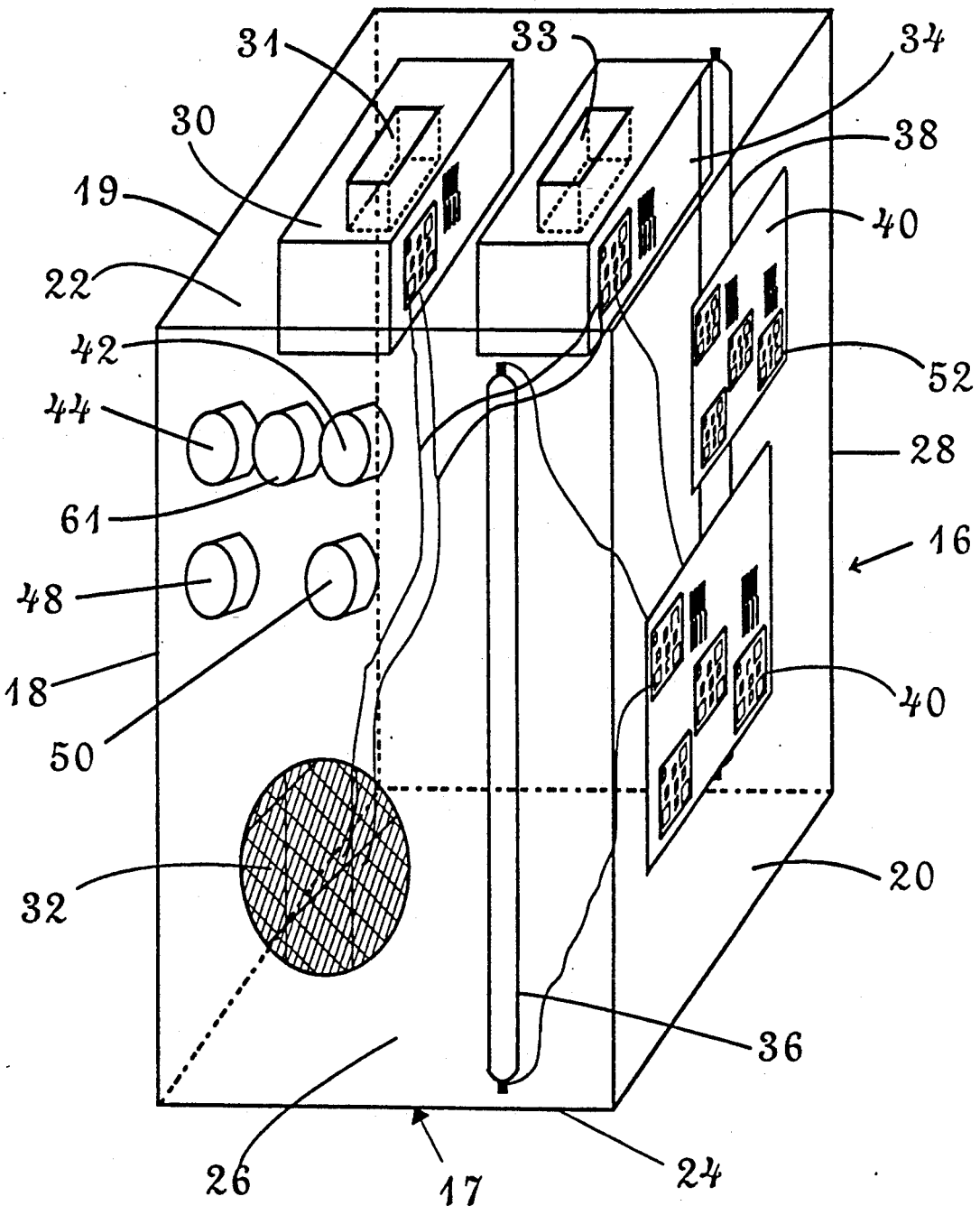
FIG. 3 is a perspective view of a preferred embodiment of a night light apparatus constructed in accordance with the invention.

Referring now to FIG. 3, a perspective view of a preferred night light apparatus is shown and generally designated as 16. The night light apparatus 16 is generally rectangular in shape and is adapted to be mounted on a wall adjacent to a child's bed.

Figure 4:
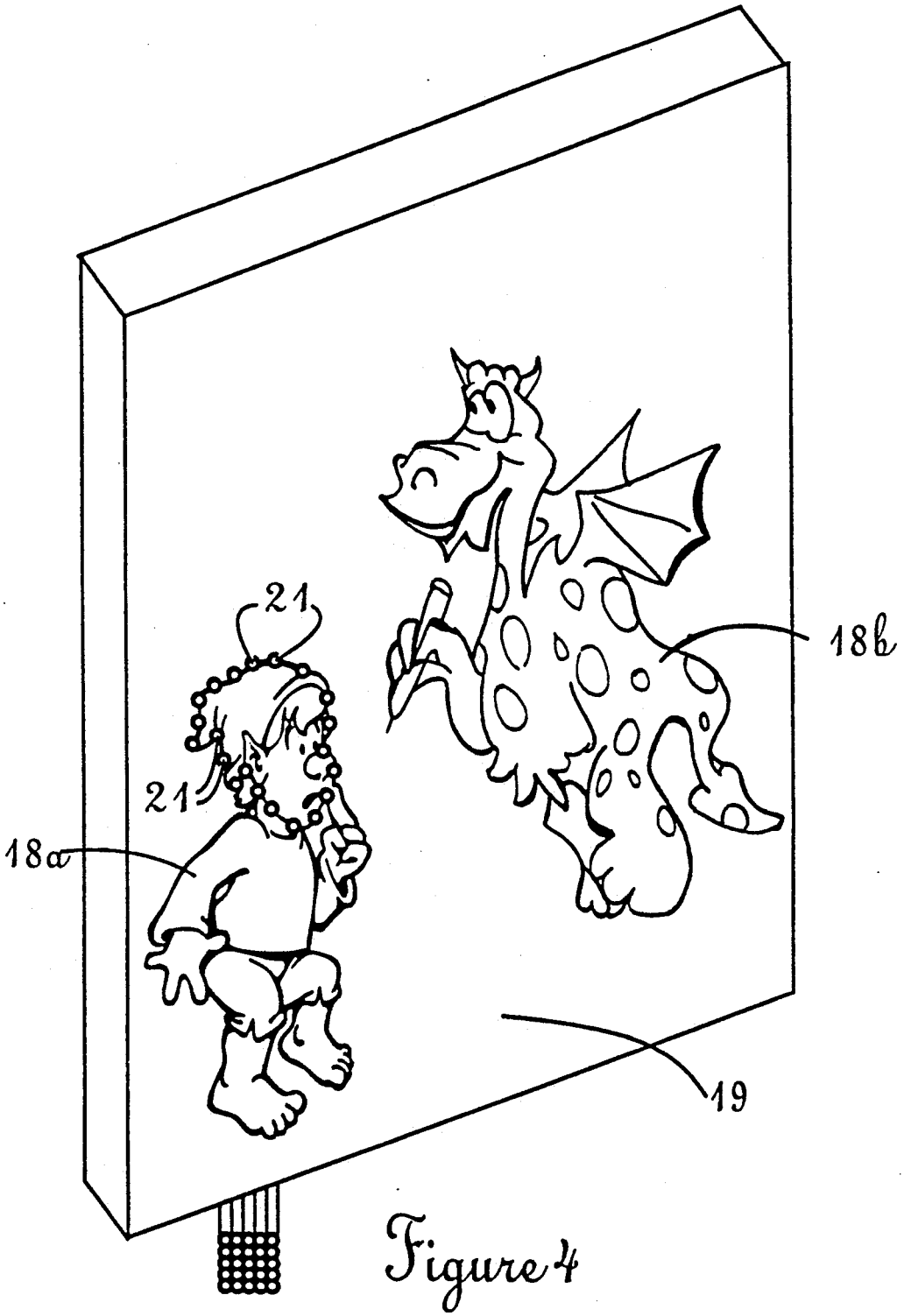
FIG. 4 is a perspective view of a face plate (surface portion) of a night light apparatus constructed in accordance with the invention.

The night light apparatus includes a rigid housing 17 having a front side 18, a back side 20, a top 22, a bottom 24, and sides 26, 28. The front side 18 of the housing 17 is preferably formed with a surface portion or face plate 19 to provide a light. The face plate 19 is clearly shown in FIG. 4. With reference to FIG. 4, the face plate 19 may be formed of translucent material such as molded plastic and may include figures recognizable to a child. In the illustrative embodiment, these figures are cartoon characters 18*a* and 18*b*. Alternately, other forms of providing an image in a darkened room may also be utilized. Additionally, surface portions other than the translucent face plate 18 may be provided. For example, the ends of fiber optic means 21 may be used to outline the image or a portion of the image 18*a*. In addition, the face plate 19 may include the end of a plurality of fiber optic strands and an image may be projected to the face plate 19 via the fiber optic strands. Moreover, it is contemplated that an image may be provided by projection onto a surface other than a face plate such as a wall or ceiling.

Referring back again to FIG. 3, to light the face plate 19 for the predetermined period of time (T2) suitable lighting means is supported in the housing 17. As an example, first and second fluorescent lamps 36 and 38 are supported in the sides 26 and 28 of the housing 17, respectively, using conventional mounting assemblies (not shown). The lighting means may alternatively include any incandescent, neon, or other conventional light, or an image generating means such as projector. Additionally, the lighting means may include a dimmer or other means for generating a light output having an intensity less than a predetermined amount.

Referring back again to FIG. 3, the night light apparatus 16 also includes a means for providing an audio output including at least one audio device. In the preferred embodiment this may include a first tape,player 30, an optional second player 34, and a speaker 32.

In an illustrative embodiment, the first tape player 30 may produce an audio output such as a "bedtime" story prerecorded on a cassette tape for the predetermined period of time (T2). The second tape player 34 may produce an audio output such as a simulated heartbeat for a predetermined period of time (T3). Of course, other aural programming material can be used. Although not shown in detail, the tape players 30, 34 have suitable openings 31, 33 situated along the top 22 of the housing to receive the cassette tape.

Alternatively, audio devices other than tape players may be provided. This may include an information storage device selected from the group consisting of a compact disk, a digitally recorded memory device, an integrated circuit chip, a three dimensional storage device, an electromagnetic device or an optical storage device.

The housing 17 also supports a control means including one or more printed circuit boards 40 (two of which are shown in FIG. 3) which include appropriate power supply and control circuitry for operating the night light apparatus 16. The night light apparatus 16 may be line-powered or, alternatively, battery powered. The housing 17 also supports components of the control means including a start switch 42, a microphone 44, a photo sensor 61 and associate photosensor switch 48, and a length-of-play selector 50 (T2). In addition a fire/smoke detector 52 may also be included in the night light apparatus 16.

Figure 5:
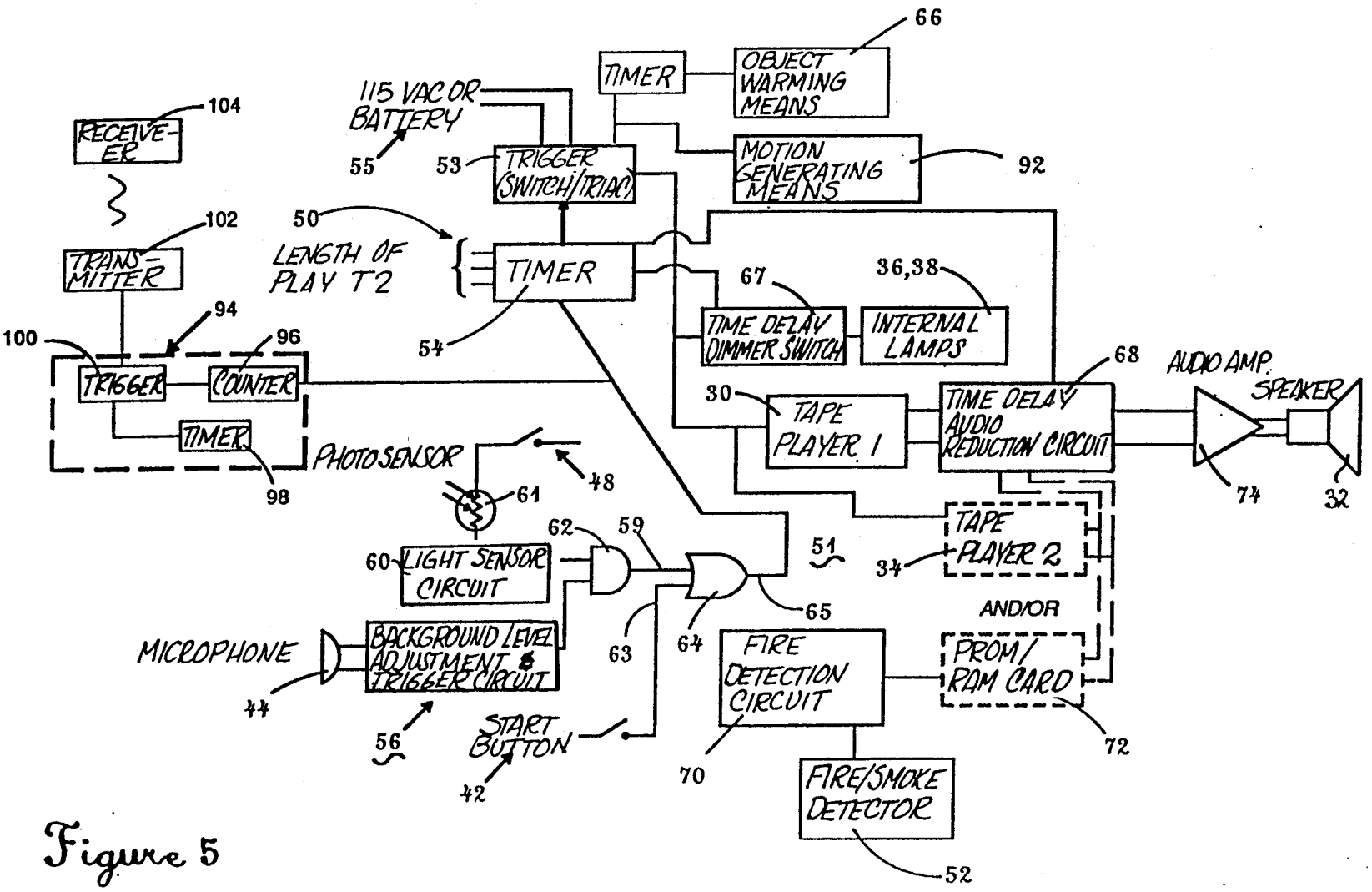
FIG. 5 is an electrical schematic for a night light apparatus constructed in accordance with the invention.

Referring now to the schematic diagram in FIG. 5, the details of one preferred electronic control means 51 for the night light apparatus 16 is shown. As described above, the control means 51 can be used to manually and/or automatically activate the tape players 30, 34 and the lamps 36, 38 to provide an audio output and a light output in accordance with the method of the invention.

The control means 51 includes a start switch or button 42, an audio background level adjustment and trigger circuit 56 connected to the microphone 44 for detecting sound levels above a noise threshold, and a light sensor circuit 60 connected to a light sensor 61 for detecting light levels below a light threshold.

Additionally, the control means 51 includes a first gate (an AND gate) 62 connected to receive the outputs of the background level adjustment and trigger circuit 56 and the light detector circuit 60. The first gate 62 thus generates an "enable" output on line 59 when a sound level is above the noise threshold and a light level is below the light threshold. A second gate (an OR gate) 64 has first 59 and second 63 inputs and an output 65 connected to a timer 54. The first input 59 of the second gate 64 is connected to receive the output of the first gate 62. The second input 63 is connected to receive the output of the start switch 42.

Additionally, the control means 51 of the night light apparatus 16 includes a trigger 53 for activating the tape player devices 30, 34 to generate an audio output and for simultaneously activating the lamps 36, 38 to light the face plate 19 to generate a light output. The trigger 53 is configured as a one shot retriggerable timer by connection to the timer element 54. The trigger 53 is activated to the "on" position by the timer 54 which thus controls the period (T2) during which the trigger 53 is activated. Upon such activation, the tape players 30, 34 and the lamps 36, 38 are connected to the power supply 55.

With reference to FIG. 5, the background level adjustment and trigger circuit 56 is shown. The function of the background level adjustment and trigger 56 circuit is to sense a predetermined audio level in the darkened room for a predetermined period of time (T1). Input into the background level adjustment and trigger circuit 56 is through microphone 44. A noise above a predetermined level within this period of time (T1) such as a child's voice, will generate a signal. Additionally, the background level of noise is automatically sensed by the background level and adjustment trigger 56. Such a circuit is known in the art as a audio level detector commercially available as a single component through Radio Shack.

In addition to detecting a noise above a certain threshold, the control means 51 also includes a light detector circuit 60 and photosensor 61. The purpose of the light detector circuit 60 and photosensor 61 is to accommodate a light being turned on in the darkened room such as by a parent. The photosensor 61 is thus set to detect light above a threshold intensity. If the light threshold is exceeded (i.e., room becomes lit) the first gate 62 (AND gate) cannot be enabled. On the other hand, if the light intensity is below the threshold, the first gate 62 can be enabled by an appropriate signal from the audio background level adjustment and trigger circuit 56.

The control means 51 may also include a means 94 for sensing the number of times a predetermined audio level has been sensed within a predetermined period of time (T4) and generating a second signal in response to the predetermined number of times said predetermined audio level has been sensed. The means 94 includes a counter 96, a timer 98 and a trigger 100. For example, each time a predetermined audio level has been sensed, a signal is generated in line 65. This signal is sensed by the counter 96. When a predetermined number of signals has been sensed by the counter 96 within a predetermined period of time (T4) by the timer 98, a signal is transmitted to the trigger. In turn, the trigger 100 transmits a signal that, in turn, activates the transmitter 102. The transmitter then transmits a signal to a remote location such as to a receiver 104. Although the transmission shown in FIG. 5 is by way of a radio signal, it would be understood that it could be accomplished in a number of other ways including the use of a line interconnecting the transmitter and the receiver, sound waves or the like.

In operation of the circuit of FIG. 5, manual depression of the start switch 42 generates an "enable" signal on line 63, thereby activating the trigger 53. This activates the lamps 36, 38 and the tape players 30, 34 to begin the bedtime story. When the timer 54 times-out (i.e., T2), the trigger 53 is deactivated, thereby turning off the lamp(s) 36, 38 and the tape players 30, 34. If desired, a delay circuit can be provided to delay the turning off of the lamps 36, 38. Thereafter, the background level adjustment and trigger circuit 56 is self adjusting to the ambient noise level in the room. If the child wakes up or otherwise cries out, a signal is generated by background level adjustment and trigger circuit 56. At the same time however, the light detector threshold must also be below a preset level as sensed by photosensor 61. If these two conditions are met, an enable signal is generated on line 59 and gates through the second gate 64 to again activate the trigger 54. Thus, retriggerable operation is provided. The period of time (T2) for activation of the trigger 53 and thus the lamps 36, 38 and tape players 30, 34 is adjustable by adjusting length of play (T2) on the timer 54. If the room becomes lit such as by a parent turning on a light in the room, this is detected by photosensor circuit 61 and gate 62 will not generate an output to activate gate 64 that in turn will activate the trigger 54. Automatic generation of an audio output and a light output is thus circumvented.

In addition to activating the lamps 36, 38 and the tape players 30, 34 to provide a light output and an audio output respectively, the trigger 53 may also activate an object warming means 66 such as a liquid warming means. This may be useful for warming a bottle of milk or other liquid for a baby or small child. If desired, a predetermined time interval (i.e., several hours) may be provided for enablement of the liquid warming means 66. Additionally, the trigger may activate a motion generating means 92 rocking a crib or bed of the child.

Additionally, a suitable electrical component such as a time delay dimmer switch 67 may be electrically connected to the lamps 36, 38 in order to gradually dim the lamps. As an example, this may be done during the later portion of time period (T2) to generate a light output having a light intensity less than a predetermined amount. In a like manner a suitable electrical component or circuit 68 may be provided to gradually reduce the level of output of the tape players 30, 34 at least during the latter part of time period (T2).

As also seen in FIG. 5, the night light apparatus 16 may also include the fire/smoke detector 52 connected to a fire detection circuit 70. The fire detection circuit 70 is preferably an alarm circuit that includes a microphone for audio input and that has a programmable read-only memory card 72 associated therewith. The card 72 includes prerecorded messages such as instructions for helping the child take some preventative actions in the event of an emergency. The messages are recorded in a digital format and converted to analog form in a conventional manner before being provided to the audio amplifier 74. Simultaneously therewith, audio output from the tape players 30, 34 is deactivated. Although not shown in detail, the fire detection circuit 70 can be connected to a home security system of a remote monitoring system.

Figure 6:
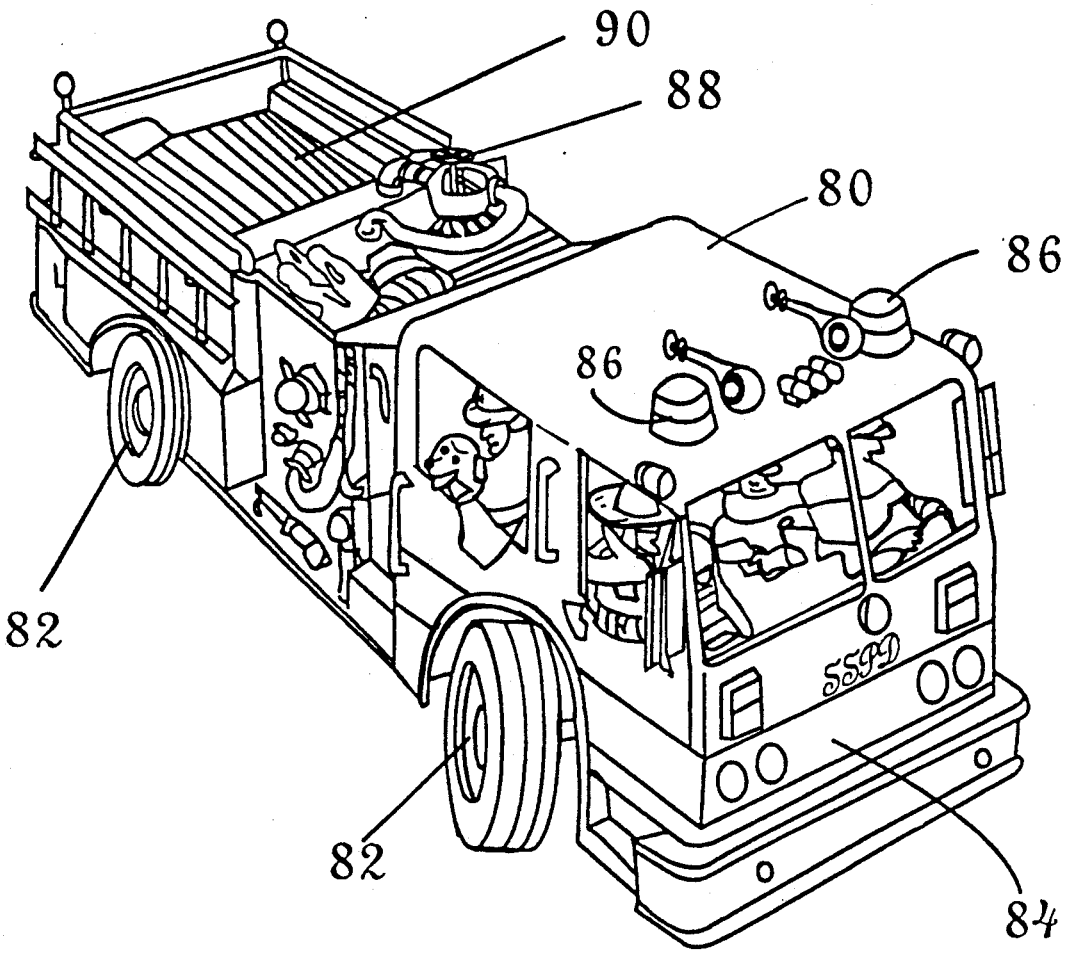
FIG. 6 is an alternate embodiment of the invention showing a night light apparatus formed in the shape of a toy fire truck.

Referring now to FIG. 6, all or part of the night light apparatus may be provided in a predetermined three-dimensional shape such as a fire truck 80. In this way, the bedtime story can be associated with a predetermined toy object. As seen in FIG. 6, the fire truck 80 includes audio output speakers 82 conveniently located in the wheels of the truck. A lighted surface portion 84 may be located along the front of the truck cab. A microphone 86 may be located within one of the horns and a fire/smoke detector 88 may be located on the upper deck. One or more tape players may be located in the rear portion 90 of the truck. The placement of these devices is, of course, exemplary and not to is be taken by way of limitation.

Thus, the present invention provides significant advantages over prior art night light apparatus. In particular, the night light apparatus is responsive to voice input from a child to alter the environment of a room with light and audio outputs. This may be useful in providing a sense of security to the child. Moreover, the intensity of light output as well as audio output may be gradually decreased. Through the use of the night light, bedtime can become more peaceful and positive experience for the child as well as the parents. A child will look forward to hearing his or her favorite stories. If the child is frightened in the night, any cries or other noises will retrigger the bedtime story and the lights to soothe the child. In this manner, the child will soon learn that he or she is in control of the sleeping situation and will thus develop necessary confidence. The fire/smoke detector also provides an additional degree of safety for the child.

It should be appreciated by those skilled in the art that the specific embodiments disclosed above may be readily utilized as a basis for modifying or designing other structures for carrying out the same purposes of the present invention. It will be understood that the method and apparatus of this invention provides a unique system for controlling the environment of a room such as a child's bedroom and, also, the ability to determine whether a child is awake without the necessity of physically going to the room. In addition, it will provide an increased sense of security to a child left in a room alone such that with the passage of time, the child will accept more readily the fact that it is time for sleep. It is believed that the use of this method and apparatus will enable a child to overcome his/her fear of the dark or being left alone in a room. Where sound waves or radio waves are transmitted to the receiver, the receiver may be easily and quickly moved from one room to another or, alternatively, a number of receivers may be utilized, each being positioned in a different room or even outdoors. It should also be realized by those skilled in the art that such equivalent constructions do not depart from the spirit and scope of the invention as set forth in the appended claims.

What is claimed is:

1. A method of altering an environment of a room for providing a sense of security to a child, said method comprising the steps of:

a. sensing an ambient audio level, and a light level in the room and generating a signal in response to detecting an audio level a predetermined amount above said ambient level when the light level in said room is equal to or less than a predetermined threshold intensity;

b. using the generated signal to activate a generator of an audio output and a light output;

c. following activation of said generator, generating an audio output and a light output in said room;

d. following generation of said audio output and light output, sensing again said pre-determined audio level in said room and generating another signal in response thereto and using said signal to activate again said generator and, following actuation of said generator, generating another audio output and light output in said darkened room;

e. providing an image in said room for viewing by said child; and f. using said generated output to illuminate said image.

2. A method as described in claim 1 and wherein:

a child's voice input produces the detected audio level; and the child's voice input is continuously sensed.

3. A method as described in claim 1 wherein:

said image is recognizable by said child.

4. A method as described in claim 1 wherein:

said image is provided on a surface portion in said room, and;

said generated light output illuminates said surface portion.

5. A method as described in claim 1 wherein:

said image is a character recognizable by said child; and said generated light output illuminates said recognizable character.

6. A method as described in claim 1 wherein:

a surface portion contains a cartoon character as said image; and said generated light output illuminates said cartoon character.

7. A method as described in claim 1 including the step of:

g. gradually reducing the intensity of the light output.

8. A method as described in claim 1 including the step of:

g. gradually reducing the level of the audio output.

9. A method as described in claim 1 including the step of:

g. gradually reducing the level of the light output and the audio output.

10. A method as described in claim 1 including the steps of:

g. detecting the existence of smoke and/or fire and generating a signal in response thereto;

h. providing a means for furnishing information in audible form instructing said child as to the course of action to pursue; and i. using the signal generated in response to said smoke and/or fire detection to activate said means for furnishing information in audible form while deactivating that portion of the generator for generating an audio output.

11. A method as described in claim 1 including the steps of:

g. counting the number of times an audio level said predetermined amount above said ambient level has been sensed within a predetermined period of time (T4) and generating a second signal in response to a predetermined number of times of sensing such an audio level;

i. using said second generated signal to activate a transmitter for transmitting a signal to a remote location; and j. receiving at said remote location the signal transmitted by said transmitter.

12. A method as described in claim 11 in which the step of receiving the transmitted signal at a remote location includes receiving the transmitted signal at a location outside said room.

13. A method of altering an environment of a room, said method comprising the steps of:

a. sensing a predetermined audio level in the room and generating a signal in response thereto;

b. using the generated signal to activate a generator of an audio output and a light output;

c. following activation of said generator, generating an audio output and a light output in said room; and d. following generation of said audio output and light output, sensing again said predetermined audio level in said room and generating another signal in response thereto and using said signal to activate again said generator and, following actuation of said generator, generating another audio output and light output in said room;

e. providing a means for warming an object;

f. providing a means for enabling activation for said object warming means; and g. using said generated signal to activate said warming means.

14. A method as described in claim 13 in which the step of providing a means for warming an object includes providing a means for warming a bottle of liquid.

15. A method as described in claim 13 including the steps of:

h. counting the number of times said predetermined audio level has been sensed within a predetermined period of time (T4) and generating a second signal in response to a predetermined number of times of sensing said predetermined audio level;

i. using said second generated signal to activate a transmitter for transmitting a signal to a remote location; and j. receiving at said remote location the signal transmitted by said transmitter.

16. A method as described in claim 15 in which the step of receiving the transmitted signal at a remote location includes receiving the transmitted signal at a location outside said room.

17. A method of altering an environment of a room, said method comprising the steps of:

a. sensing a predetermined audio level in the room and generating a signal in response thereto;

b. using the generated signal to activate a generator of an audio output and a light output;

c. following activation of said generator, generating an audio output and a light output in said room; and d. following generation of said audio output and light output, sensing again said predetermined audio level in said room and generating another signal in response thereto and using said signal to activate again said generator and, following actuation of said generator, generating another audio output and light output in said room;

e. providing an image in said room; and f. providing fiber optic means to convey the generating light output to said image.

18. A method of altering an environment of a room, said method comprising the steps of:

a. sensing a predetermined audio level in the room and generating a signal in response thereto;

b. using the generated signal to activate a generator of an audio output and a light output;

c. following activation of said generator, generating an audio output and a light output in said room;

d. following generation of said audio output and light output, sensing again said predetermined audio level in said room and generating another signal in response thereto and using said signal to activate again said generator and, following actuation of said generator, generating another audio output and light output in said room; and e. providing an image in said room, at least a portion of said image being formed, in part, by fiber optic means operatively associated with said signal generator.

19. A method as described in claim 18 in which the step of generating an audio output and light output includes generating a light output having an intensity less than a predetermined threshold intensity.

20. A method as described in claim 18 wherein:

said image is of a cartoon character; and said generated light output illuminates said image of said cartoon character.

21. A method as described in claim 18 wherein:

said image is provided by using said generated light output to convey to a surface portion in said room an image recognizable by said child.

22. A method as described in claim 18 wherein:

said image is provided as a surface portion containing a cartoon character; and said generated light output illuminates said cartoon character.

23. A method as described in claim 18 including the step of:

f. reducing gradually the intensity of the light output.

24. A method as described in claim 18 including the steps of:

f. following the second generation of said audio output and said light output, sensing again said predetermined audio level in said room and generating a signal in response thereto and using said signal to activate said generator; and g. following actuation of said generator, generating yet another another output imitating a heartbeat and another light output in said room.

25. A method of altering an environment of a room, said method comprising the steps of:

a. sensing a predetermined audio level in the room and generating a signal in response thereto;

b. using the generated signal to activate a generator of an audio output and a light output;

c. following activation of said generator, generating an audio output and a light output in said room;

d. following generation of said audio output and light output, sensing again said predetermined audio level in said room and generating another signal in response thereto and using said another signal to activate again said generator and, following actuation of said generator, generating another audio output and light output in said room;

e. gradually reducing the level of the light output and the audio output;

f. providing a means for warming an object;

g. providing a means for activating said object warming means; and h. following an interval of time, using said generated signal to activate said object warming means.

26. A method as described in claim 25 including the steps of:

i. providing an image in said room; and j. using said generated light output to illuminate said image.

27. A method of altering an environment of a room, said method comprising the steps of:

a. sensing an ambient audio level and a light level in the room and generating a signal in response to detecting an audio level a predetermined amount above said ambient level when the light level in said room is equal to or less than a predetermined threshold intensity;

b. using the generated signal to activate a generator of an audio output and a light output;

c. following activation of said generator, generating an audio output and a light output in said room;

d. following generation of said audio output and light output, sensing again said predetermined audio level in said room and generating another signal in response thereto and using said another signal to activate again said generator and, following actuation of said generator, generating another audio output and light output in said room;

e. following the second generation of said audio output and said light output, sensing again said predetermined audio level in said room and generating a third signal in response thereto and using said third signal to activate said generator;

f. following actuation of said generator, generating yet another audio output and light output in said room;

g. providing an image in said room;

h. using said generated light output to illuminate said image; and i. reducing the intensity of the light output during a part of one of the times light output is being generated.

28. A method as described in claim 27 in which the step of generating an audio output and light output includes generating a light output having an intensity less than a predetermined threshold intensity.

29. A method as described in claim 27 wherein:

said image in said room is recognizable by a child; and said generated light output illuminates said recognizable image.

30. A method as described in claim 27 wherein:

said image is provided by using said generated light output to convey to a surface portion in said room an image recognizable by a child.

31. A method as described in claim 27 wherein:

said image is provided by using said generated light output to illuminate in said room a character recognizable by said child.

32. A method as described in claim 27 wherein:

said image is provided by using said generated light output to illuminate a surface portion containing a cartoon character.

33. A method of altering an environment of a darkened room for providing a sense of security to a child, said method comprising the steps of:

a. providing a generator for generating an audio output and light output in the darkened room;

b. activating said generator for a first predetermined period of time;

c. following generation of said audio output and light output for said first predetermined period of time, periodically sensing a predetermined audio level above an ambient level in the darkened room for a second predetermined period of time and generating a signal in response to the child's voice input at the predetermined audio level above said ambient level;

d. using the generated signal to activate the generator of an audio output and light output for a second predetermined period of time;

e. following activation of said generator for said second predetermined period of time in response to said generated signal, sensing again said ambient audio level in said darkened room and generating another signal in response to a child's voice input at a predetermined level above said ambient level and using said signal to activate said generator for a third predetermined period of time and, following activation of said generator, generating another audio output and light output in said darkened room for a third predetermined period of time and wherein, the step c is performed only when sensing a light intensity in the darkened room having an intensity less than a predetermined amount.

34. A method as described in claim 33 including the steps of:

f. providing an image in said darkened room; and g. using said generated light output to illuminate said image.

35. A method as described in claim 33 including the steps of:

f. providing an image in said darkened room that is recognizable by said child; and g. using said generated light output to illuminate said recognizable image.

36. A method as described in claim 33 including the steps of:

f. providing a surface portion in said room, and;

g. using said generated light output to convey an image onto said surface portion, said image being recognizable by said child.

37. A method as described in claim 33 including the steps of:

f. providing a surface portion in said room, and;

g. using said generated light output to convey an image to said surface portion, said image being recognizable by said child.

38. A method as described in claim 33 including the steps of:

f. providing a character in said room recognizable to said child; and g. using said generated light output to illuminate said recognizable character.

39. A method as described in claim 33 including the steps of:

f. providing in said room a surface portion containing a cartoon character; and g. using said generated light output to illuminate said cartoon character.

40. A method as described in claim 33 including the steps of:

f. detecting the existence of smoke and/or fire and generating a signal in response thereto;

g. providing a means for furnishing information in audible form instructing a child as to the course of action to pursue; and h. using the signal generated by said smoke and/or fire detector to activate said means for furnishing information in audible form while deactivating that portion of the generator for generating an audible output.

41. A method as described in claim 33 including the steps of:

f. providing a means for warming an object;

g. providing a means for activating said object warming means after a predetermined interval of time; and h. following said predetermined interval of time, using the generated signal to activate said object warming means following expiration of said predetermined interval of time.

42. A method as described in claim 33 in which the step of providing a means for warming an object includes providing a means for warming a bottle of liquid.

43. A method as described in claim 33 including the step of:

f. reducing the intensity of light output at least during the latter part of said second predetermined period of time.

44. A method as described in claim 33 including the step of:

f. reducing the level of audio output at least during the latter part of said second predetermined period of time.

45. A method as described in claim 33 including the step of:

f. reducing the level of the audio output and the intensity of the light output at least during the latter part of said second predetermined period of time.

46. A method as described in claim 33 in which the step of generating an audio output and light output includes generating a light output having an intensity less than a predetermined threshold intensity.

47. A method as described in claim 33 in which the step of generating an audio output includes forming said audio output as a sound like the heartbeat of the child's mother.

48. An apparatus for altering the environment of a room and for providing a source of security for a child, comprising:

a. means for sensing an ambient audio level and a light level in a room for a predetermined period of time (T1) and generating a signal in response to the child's voice input at a level a predetermined amount above said ambient audio level only when the light level in said room is equal to or less than a predetermined threshold intensity;

b. means for generating an audio output and light output in said room;

c. mean responsive to said generated signal to activate said means for generating an audio output and light output for a second predetermined period of time (T2); and d. a surface portion containing an image for viewing by the child, said image being illuminated by said means for generating an audio output and light output.

49. An apparatus as described in claim 48 wherein: said image is a character recognizable by said child.

50. An apparatus as described in claim 48 wherein: said image is a cartoon character.

51. An apparatus as described in claim 48 including:

e. means for reducing the intensity of the light output at least during the latter part of said second predetermined period of time (T2).

52. An apparatus as described in claim 48 including:

e. means for reducing the level of audio output and the intensity of the light output at least during the latter part of said second predetermined period of time (T2).

53. An apparatus as described in claim 48 including:

e. means for detecting the existence of smoke and/or fire and generating a signal in response thereof;

f. means for furnishing in said room information in audible form instructing said child as to the course of action to pursue; and g. means for activating said information furnishing means and deactivating that portion of the generator for generating an audio output.

54. An apparatus as described in claim 48 including:

e. means for warming an object; and f. means for activating said object warming means after a predetermined interval of time, said means including the signal generated by said means responsive to said generated signal.

55. An apparatus as described in claim 54 in which said means for warming an object includes a means for warming a bottle of liquid.

56. An apparatus as described in claim 54 including:

g. means for sensing the number of times said predetermined audio level has been sensed within a predetermined period of time (T4) and generating a second signal in response to a predetermined number of times of sensing said predetermined audio level;

h. means for using said second generated signal to activate a transmitter for transmitting a signal to a remote location; and i. means for receiving at a remote location the signal transmitted by said transmitter.

57. An apparatus as described in claim 56 in which the means for receiving the transmitted signal at a remote location includes the means for receiving the transmitted signal at a location outside said room.

58. An apparatus as described in claim 48 including:

e. means for sensing the number of times said predetermined audio level has been sensed within a predetermined period of time (T4) and generating a second signal in response to a predetermined number of times of sensing said predetermined audio level;

f. means for using said second generated signal to activate a transmitter for transmitting a signal to a remote location; and g. means for receiving at a remote location the signal transmitted by said transmitter.

59. An apparatus as described in claim 48 including:

e. means for periodically generating a sound like a heartbeat of the child's mother;

f. means for activating said means for generating the sound like a heartbeat of the child's mother for a third predetermined period of time (T3).

60. An apparatus as described in claim 48 wherein:

e. fiber optic means is operatively associated with said light generating means to convey the generated light output to said illuminated image.

61. An apparatus as described in claim 48 wherein:

at least a portion of said illuminated image is formed, in part, by fiber optic means operatively associated with said illuminated image.

62. An apparatus for altering the environment of a room for providing a sense of security to a child in the room comprising:

a. means for generating an audio output and a light output to illuminate an image in the room;

b. means for activating for a first predetermined period of time said means for generating an audio output and a light output in said room;

c. means for sensing an ambient audio level in said room and a light level in said room for a second predetermined period of time and generating a signal in response to a child's voice input above said ambient audio level when said light level in said room is equal to or less than a predetermined threshold intensity;

d. means for using said generated signal to activate said means for generating an audio output and a light output for said first predetermined period of time.

63. An apparatus as described in claim 62 including:

e. a surface portion; and f. means for conveying to said surface portion an image recognizable to said child, said means including the means for generating an audio output and light output.

64. An apparatus as described in claim 62 including:

e. a surface portion containing an image, said image being illuminated by said means for generating an audio output and light output.

65. An apparatus as described in claim 62 including:

e. a surface portion containing a character recognizable by said child, said character being illuminated by said means for generating an audio output and light output.

66. An apparatus as described in claim 62 including:

e. a surface portion containing a cartoon character, said cartoon character being illuminated by said means for generating an audio output and light output.

67. An apparatus as described in claim 62 including:

e. means for reducing the intensity of the light output at least during the latter part of said first predetermined period of time.

68. An apparatus as described in claim 62 including:

e. means for reducing the level of audio output and the intensity of light output at least during the latter part of said first predetermined period of time.

69. An apparatus as described in claim 62 including:

e. means for reducing the level of audio output at least during the latter part of said first predetermined period of time.

70. An apparatus as described in claim 62 including:

e. means for detecting the existence of smoke and/or fire and generating a signal in response thereto;

f. means for furnishing in said room information in audible form instructing said child in the course of action to pursue; and g. means for activating said information furnishing means and deactivating that portion of the generator for generating an audio output.

71. An apparatus as described in claim 62 including:

e. means for warming an object; and f. means for activating said object warming means after a predetermined interval of time (T3), said means responsive to the signal generated in response to said child's voice input.

72. An apparatus as described in claim 62 including:

e. means for generating motion for rocking said child's bed; and f. means for activating said means for generating motion.

73. An apparatus as described in claim 62 including:

e. means responsive to said activating means for said first predetermined period of time for periodically generating a sound like a heartbeat of the child's mother.

74. A night light apparatus, comprising:

a. a housing containing a portion of a pre-determined shape of a cartoon character and having a surface portion thereof formed of a translucent material;

b. at least one audio output means supported in the housing for generating an audio output;

c. at least one light output means supported in the housing for lighting the translucent material; and d. electronic control means for controlling operation of the audio output means and light output means, the electronic control means comprising;

(1) an audio level detection means for detecting sound levels above a pre-determined audio threshold including a child's voice and generating a signal in response thereto;

(2) a trigger for activating the audio output means to generate the audio output and for activating the light output means to light the housing;

(3) means for receiving the signal generated by the audio detection means and activating said trigger in response thereto;

(4) a timer for controlling a period during which the trigger is activated;

(5) a start switch for manually activating said trigger;

(6) light detection means for detecting light levels below a light threshold and generating a signal in response thereto; and (7) means for receiving the signal generated by the light detection means and activating said audio output means and said light output means in response thereto.

75. A night light apparatus as described in claim 74 wherein at least a part of said surface portion includes a portion of a recognizable character.

76. A night light apparatus as described in claim 74 wherein at least a part of said surface portion includes a portion of a recognizable cartoon character.

77. A night light apparatus as described in claim 74 wherein the audio output means is an audio cassette player and the audio output is prerecorded.

78. A night light apparatus as described in claim 74 including:

e. a means supported in the housing and operable by said electronic control means for generating a second audio output.

79. A night light apparatus as described in claim 78 in which said second audio output sounds like a heartbeat.

80. A night light apparatus as described in claim 74 wherein the control means further includes a fire and/or smoke detector connected to the electronic control means.

81. A night light apparatus as described in claim 74 wherein said audio output means includes an information storage device selected from the group consisting of a compact disk, a digitally recorded memory device, an integrated circuit chip, a three dimensional storage device, an electromagnetic device, and an optical storage device.

82. A night light apparatus as described in claim 74 in which the light output means includes an image generating means.

83. A night light apparatus as described in claim 74 wherein the audio detection means includes means for adjusting the audio threshold based on the detected ambient audio level.

84. A night light apparatus comprising:

a. a housing;

b. a surface portion, said housing including means for supporting said surface portion;

c. at least one lighting means for lighting said surface portion;

d. a first audio device and an audio output device supported by the housing for generating a first audio output;

e. a second audio device connected to the audio output device and supported by the housing for generating a second audio output that simulates a heartbeat; and f. a control means for automatically activating the audio devices and the lighting means in response to a child's voice by sensing a predetermined audio level for a predetermined period of time.

85. A night light apparatus as described in claim 83 in which said control means includes:

(g) a first gate connected to receive the output of an audio detection means and the output of a light detection means and in response thereto generating a re-trigger output when, following time-out of a timer, a sound level above an audio threshold is detected and a light level below a light threshold is detected; and (h) a second gate having first and second inputs and an output connected to the timer, the first input of the second gate being connected to receive the output of the first gate and the second input being connected to receive the output of a start switch.

86. A night light apparatus as described in claim 85 wherein the surface portion includes an image of cartoon character and the audio output is a story about the cartoon character.

87. A night light apparatus as described in claim 85 wherein the light detection means includes means for adjusting the light threshold.

88. A night light apparatus for providing a sense of security to a child in a darkened room comprising:

a. a housing;

b. means for conveying an image, said means including a surface portion;

c. at least one audio device and an audio output device supported by the housing for generating an audio output;

d. at least one lighting means for lighting said surface portion; and e. control means for controlling the operation of the audio device and the lighting means, said control means comprising:

(1) light detection means for detecting a light level in said room;

(2) audio detection means for detecting audio levels above a pre-determined threshold level and generating a signal indicative thereof when the light level in said room is equal to or less than a predetermined threshold intensity;

(3) trigger means for activating the audio device to generate the audio output and for activating the lighting means to light said surface portion;

(4) said trigger means being actuated by the signal generated by said audio detection means;

(5) timing means for controlling the period during which the trigger means is activated; and (6) means for controlling the operation of the timing means.

89. A night light apparatus as described in claim 88 and further comprising a motion generating means coupled to and operable by the trigger means for rocking a bed of the child.

90. A method of altering an environment of a darkened room for providing a sense of security to a child, said method comprising the steps of:

a. sensing the light level in the darkened room and generating a first signal in response to sensing an audio level a predetermined amount above an ambient level when the light level in said room is equal to or less than a predetermined threshold intensity;

b. using the first generated signal to activate a generator of an audio output and a light output;

c. following activation of said generator, generating an audio output and light output in said room for a predetermined first period of time thereby providing a sense of security to a child during said predetermined first period of time; and d. following cessation of generation of said audio output and light output for said predetermined first period of time, sensing again said predetermined audio level above an ambient level in said darkened room and generating a second signal in response thereto and using said second signal to activate again said generator and, following activation of said generator, generating another audio output and light output in said darkened room for a predetermined second period of time, thereby providing a sense of security to said child during said predetermined second period of time.

91. A method of altering an environment of a darkened room for providing a sense of security to a child, said method comprising the steps of:

a. sensing a predetermined audio level above an ambient level in the darkened room and generating first signal in response thereto;

b. using the first generating signal to activate a generator of an audio output;

c. following activation of said generator, generating an audio output imitating a heartbeat in said room for a predetermined first period of time thereby providing a sense of security to a child during said predetermined first period of time; and d. following cessation of generation of said audio output for said predetermined first period of time, sensing again said predetermined audio level above an ambient level in said darkened room and generating a second signal in response thereto and using said second signal to activate again said generator and, following activation of said generator, generating another audio output imitating a heartbeat in said darkened room for a predetermined second period of time, thereby providing a sense of security to said child during said predetermined second period of time.

92. A method for altering the environment of a room comprising:

a. sensing in said room an ambient audio level and a light level;

b. sensing an audio level a predetermined amount above said ambient level and generating a signal in response thereto only when the light level in said room is equal to or less than a predetermined threshold intensity;

c. using said signal to actuate a generator of an audio output and a light output in said room; and d. altering the environment in said room by maintaining said audio output and light output for a predetermined period of time.

93. A method as described in claim 92 in which the step of sensing the predetermined audio level above said ambient level includes sensing a child's voice when it exceeds said ambient level.

94. A method as described in claim 93 and wherein said light output is used for illuminating an image.

95. A method as described in claim 94 and wherein said audio output is a bedtime story.

96. A method as described in claim 92 including conveying at least a portion of the generated light output by fiber optic means.

97. A method as described in claim 92 including gradually reducing the level of the light output following expiration of said predetermined period of time.

98. A method as described in claim 92 including gradually reducing the level of the audio output following expiration of said predetermined period of time.

99. A method as described in claim 92 in which said audio output in step (d) includes a heartbeat.

100. A method as described in claim 92 in which step (c) includes activating a transmitter for transmitting a signal to a remote location and receiving at said remote location the signal transmitted by said transmitter.

101. A method as described in claim 92 and wherein said light output is used for projecting an image.

* * * * *